US011029007B2

(12) United States Patent
Sui et al.

(10) Patent No.: US 11,029,007 B2
(45) Date of Patent: Jun. 8, 2021

(54) MULTIFUNCTIONAL FLASHLIGHT SUPPORT

(71) Applicant: Dongguan Olight E-Commerce Technology Co., Ltd., Guangdong (CN)

(72) Inventors: Ya Bing Sui, Henan (CN); Si Wei, Guangxi (CN)

( * ) Notice: Subject to any disclaimer, the term of this patent is extended or adjusted under 35 U.S.C. 154(b) by 0 days.

(21) Appl. No.: 16/939,074

(22) Filed: Jul. 27, 2020

(65) Prior Publication Data

US 2020/0355354 A1 Nov. 12, 2020

(30) Foreign Application Priority Data

Jun. 24, 2020 (CN) ..... 202010584975.9

(51) Int. Cl.

| | |
|---|---|
| ***F21L 4/08*** | (2006.01) |
| ***F21V 21/096*** | (2006.01) |
| ***F21S 6/00*** | (2006.01) |
| ***F21V 21/002*** | (2006.01) |
| ***F21V 13/14*** | (2006.01) |
| ***F21V 13/04*** | (2006.01) |

(52) U.S. Cl.

CPC ..... *F21V 21/0965* (2013.01); *F21L 4/08* (2013.01); *F21V 13/045* (2013.01); *F21V 13/14* (2013.01); *F21V 21/002* (2013.01)

(58) Field of Classification Search

CPC ..... F21L 4/08; F21V 5/006; F21V 7/0075; F21V 9/083; F21V 13/045; F21V 21/0965

See application file for complete search history.

(56) References Cited

U.S. PATENT DOCUMENTS

| | | | | |
|---|---|---|---|---|
| 4,989,123 | A * | 1/1991 | Best | A45B 3/04 135/16 |
| 5,645,341 | A * | 7/1997 | Liao | F21L 4/08 362/183 |
| 6,502,954 | B1 * | 1/2003 | Demkowski | F21L 4/00 362/102 |
| 2012/0147595 | A1 * | 6/2012 | Wang | F21L 4/08 362/183 |

* cited by examiner

*Primary Examiner* — Sean P Gramling

(74) *Attorney, Agent, or Firm* — Prakash Nama; Global IP Services, PLLC

(57) ABSTRACT

A multifunctional flashlight support, including a base, a connecting rod assembly and an optical component; the base is connected with the optical component through the connecting rod assembly, a flashlight is installed in a detachable way on the base, and the optical component abuts against the light outlet of the flashlight to serve for changing the light direction of the flashlight. The flashlight is installed on the base of the support, and the direction of light from the flashlight is changed through the optical component, so the original unidirectional direction of the light beam from the flashlight can be changed through the optical component or the light beam is further dispersed to achieve the floodlighting effect, and the flashlight turns into a desk lamp, or a camping light or a wall light giving a wider lighting range, with the lighting function achieved when it is not held by hand.

9 Claims, 7 Drawing Sheets

MULTIFUNCTIONAL FLASHLIGHT SUPPORT

BACKGROUND OF THE INVENTION

The invention belongs to the technical field of lighting, and particularly relates to a multifunctional flashlight support.

Flashlights are common mobile lighting equipment. But the flashlights must be held by hand, which is inconvenient and fails to meet the lighting requirements of the users in different situations.

In order to free users' hands when they use the flashlight, the flashlight is generally installed on a support. However, with simple structure, the existing flashlight support is applied only within a limited range.

Thus, the current flashlight support has the problems of simple structure and single function.

BRIEF SUMMARY OF THE INVENTION

The invention aims to provide a flashlight support to overcome the shortcomings in the prior art. It can turn into a desk light or a camping light while users' hands are freed, and increase the possibilities of the flashlight for various applications.

In order to achieve the above-mentioned purpose, the following technical solution is used for the invention:

A multifunctional flashlight support comprises a base, a connecting rod assembly and an optical component, wherein, the base is connected with the optical component through the connecting rod assembly, a flashlight is installed in a detachable way on the base, and the optical component abuts against the light outlet of the flashlight to serve for changing the light direction of the flashlight.

Preferably, the connecting rod assembly is connected in a rotatable way with the optical component and the base separately.

Preferably, the connecting rod assembly comprises a first bending rod and a second bending rod, wherein, the first bending rod is connected in a rotatable way with the second bending rod, the base is connected at the end of the first bending rod far away from the second bending rod, and the optical component is connected at the end of the second bending rod far away from the first bending rod.

Further, the first bending rod comprises a bending portion and a telescopic portion, wherein, the bending portion is connected in a rotatable way with the base, a telescopic rod is contained in the inner cavity of the telescopic portion, the telescopic rod is connected in a slidable way with the first bending rod, and the telescopic rod is connected in a rotatable way with the second bending rod.

Preferably, a charging device and a power interface are arranged in the base, the charging device is connected with an external power supply through the power interface, and the charging device is used for charging the flashlight installed on the base.

Further, a magnetic interface for connecting the flashlight is arranged on the charging device.

Preferably, the optical component comprises a lens assembly, and the lens assembly further comprises a lens and a top cover, wherein, the top cover is located on the side of the lens far away from the light inlet, and light from the flashlight enters the inner cavity of the lens through the light inlet and diverges around the periphery of the lens after being refracted and/or reflected.

Further, the optical component further comprises a light filtering assembly, wherein, the light filtering assembly is arranged at the light inlet of the lens.

Preferably, a hanging ring is arranged on the top cover, and the hanging ring is connected in a rotatable way with the top cover.

Preferably, the multifunctional flashlight support comprises at least one first accessory, and the first accessory further comprises a platy shell and a mounting groove protruding from the platy shell, wherein, the first accessory is connected in a rotatable way with the connecting rod assembly through the mounting groove.

The multifunctional flashlight support has the following beneficial effects: the invention provides a multifunctional flashlight support. The flashlight is installed on the base of the support, and the direction of light from the flashlight is changed through the optical component, so the original unidirectional direction of light beam from the flashlight can be changed through the optical component or the light beam is further dispersed to achieve the floodlighting effect, and the flashlight turns into a desk lamp, or a camping light or a wall light giving a wider lighting range, with the lighting function achieved when it is not held by hand. The relative positions of the optical component, the connecting rod assembly and the base can be adjusted according to different storage spaces, so as to change the shape of the support and meet different storage requirements. The telescopic rod can slide relative to the first bending rod, so as to increase the overall height of the connecting rod assembly and adapt to the flashlights of different heights, showing a high applicability. A charging device is arranged in the base to serve for charging the flashlight arranged on the base, and the support is easy to assemble, extensive in applications, and diversified in functions. A first accessory is arranged for the multifunctional flashlight support, and the support with the flashlight can be attached to a wall, used as a wall light, through adding binders or an adhesive tape to the side of the platy shell far away from the mounting groove.

Figure 1:
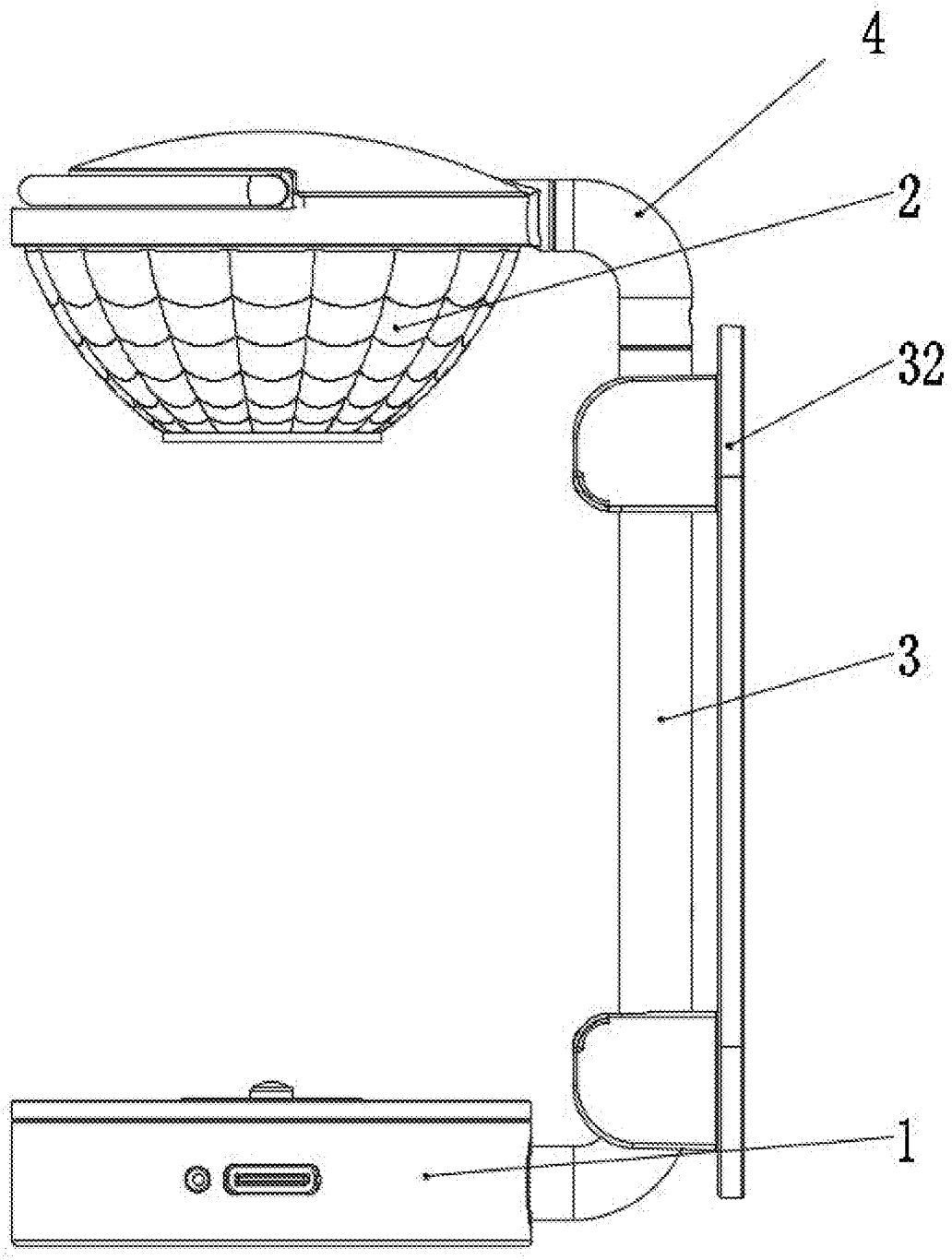
FIG. 1 is the main view of the multifunctional flashlight support.

In the figures: 1—base; 2—optical component; 3—first bending rod; 4—second bending rod; 5—telescopic rod; 6—steel sleeve; 7—first locating ball; 8—lantern ring; 9—pin; 10—second locating ball; 11—anti-rotating block; 12—first screw; 13—locating block; 14—first elastic piece; 15—first washer; 16—power interface; 17—charging PCB; 17-1—second elastic piece; 18—charging connecting plate; 18-1—third elastic piece; 19—contact cap; 20—metal ring; 21—second screw; 22—magnet; 23—hold-down ring; 24—indicator light plug; 25—third locating ball; 26—lens;

27—top cover; 28—hanging ring; 31—second washer; 32—first accessory; 32-1—mounting groove; 33—flashlight; 101—bottom shell; 102—upper cover; 301—bending portion; 301-1—wavy groove; 302—telescopic portion.

DETAILED DESCRIPTION OF THE INVENTION

The following is the detailed description of the embodiments of the invention, and the example of the embodiments is shown in the figure, wherein the same or similar numbers from beginning to end represent the same or similar elements or the elements with the same or similar functions. The following embodiments described by reference to the drawings are exemplary, aiming at explaining the invention, rather than understanding as the limitation to the invention.

In the description of the invention, it should be understood that the directions or position relationships indicated by the terms "length", "width", "upper", "lower", "front", "back", "left", "right", "vertical", "horizontal", "top", "bottom", "inner", "outer" and the like are based on the directions or the position relationships shown in the figures, only for facilitating description of the invention and simplification of the description, other than indicating or implying that the indicated devices or elements must have the specific direction, are structured and operated in the specific direction; thus, the terms cannot be understood as limitations to the invention.

In addition, the terms "first" and "second" are used for the description purpose only, but cannot be understood as indicating or implying relative importance or implying the quantity of the indicated technical characteristics. Thus, the characteristics with the determiners "first" and "second" can expressly or implicitly include one or more characteristics. In the description of the invention, the meaning of "multiple" is two or more, unless otherwise specified definitely.

In the embodiment of the invention, unless otherwise specified and limited expressly, the terms "installation", "link", "connection", "fixation" and the like should be understood generally; for example, the connection can be fixed, detachable connection or integration; it can be mechanical connection, electric connection, direct connection or indirect connection through intermedia, communication between two elements or interactive relationship between two elements. Those skilled in the art can understand the specific meaning of the above terms in the invention according to the specific conditions.

As shown in FIG. 1-FIG. 8, the invention provides a multifunctional flashlight support, comprising a base 1, a connecting rod assembly and an optical component 2, wherein, the base 1 is connected with the optical component 2 through the connecting rod assembly, a flashlight is installed in a detachable way on the base 1, and the optical component 2 abuts against the light outlet of the flashlight to serve for changing the light direction of the flashlight.

The connecting rod assembly is connected in a rotatable way with the base 1 and the optical component 2 separately. When the bottom of the flashlight is installed on the base 1, the light outlet of the flashlight abuts against the optical component 2, and the direction of light from the flashlight is changed through the optical component 2, so the original unidirectional direction of light beam from the flashlight can be changed through the optical component 2 or even the light beam is further dispersed to achieve the floodlighting effect, and the flashlight turns into a desk lamp, or a camping light giving a wider lighting range.

Figure 2:
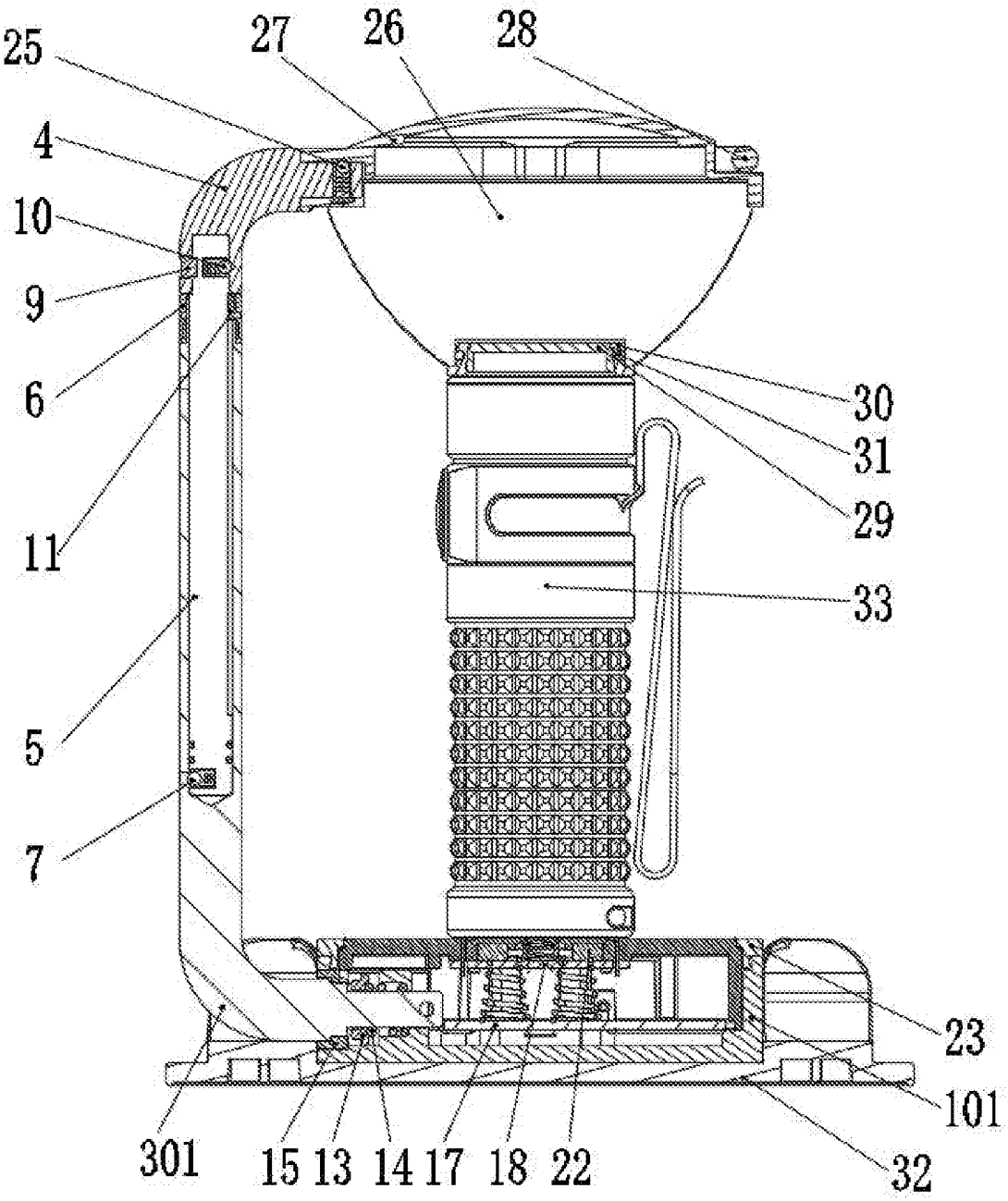
FIG. 2 is the section view of the multifunctional flashlight support.
Figure 3:
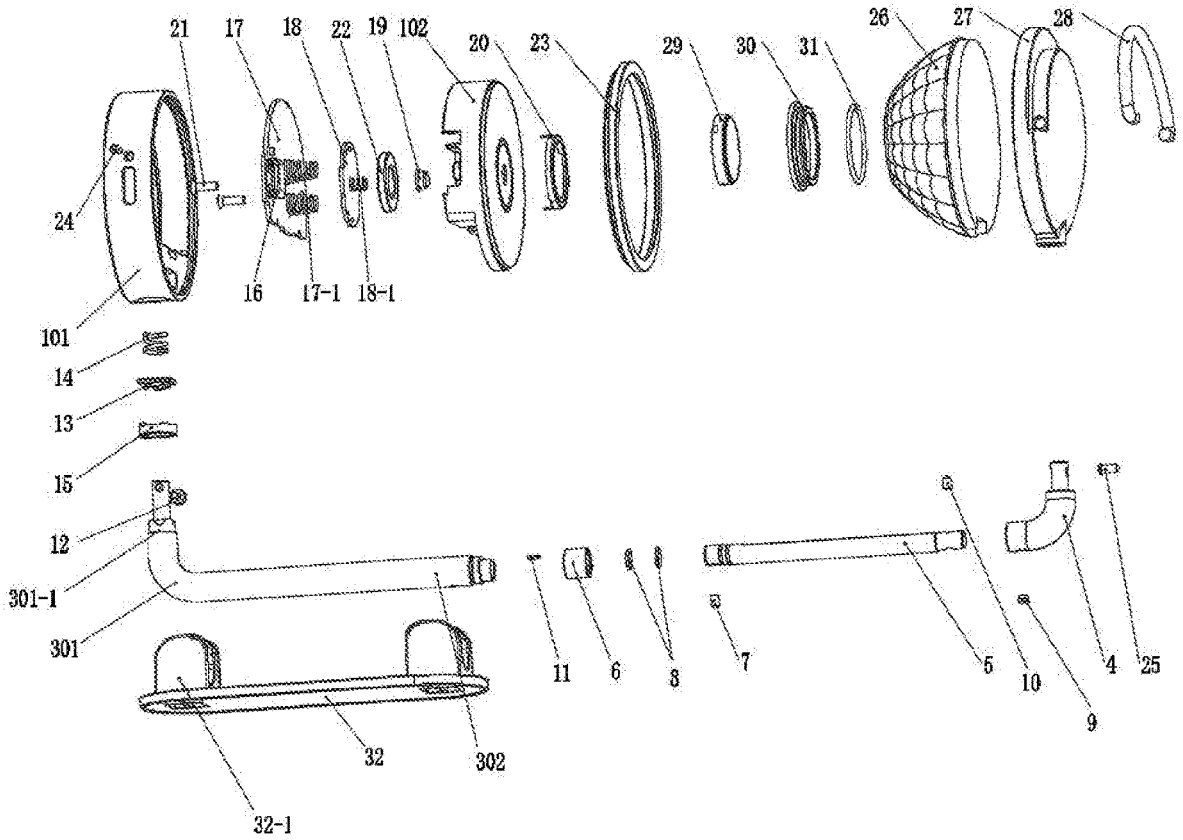
FIG. 3 is the exploded view of the multifunctional flashlight support.
Figure 5:
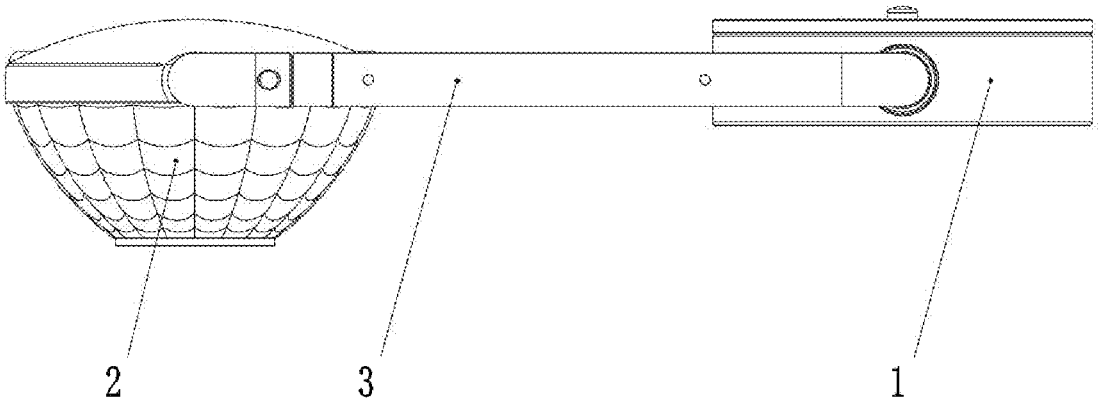
FIG. 5 is the structural diagram of the multifunctional flashlight support stowed.

As shown in FIG. 1-FIG. 3, in the embodiment, the connecting rod assembly is connected in a rotatable way with the optical component 2 and the base 1 separately. The optical component 2 can be rotated relative to the connecting rod assembly, and the connecting rod can be rotated relative to the base 1. When the flashlight is installed, the optical component 2, the connecting rod assembly and the base 1 are adjusted to the positions as shown in FIG. 1, and then the flashlight can be installed on the support, turning into a desk light, a wall light or a camping light; when the support is stowed, the optical component 2, the connecting rod assembly and the base 1 can be rotated to the positions as shown in FIG. 5, so that the optical component 2, the connecting rod assembly and the base 1 are all located on the same horizontal plane, thereby facilitating packaging and carrying. Certainly, the relative positions of the optical component 2, the connecting rod assembly and the base 1 can be adjusted according to different storage spaces, so that the shape of the support is changed to meet different storage requirements.

Figure 4:
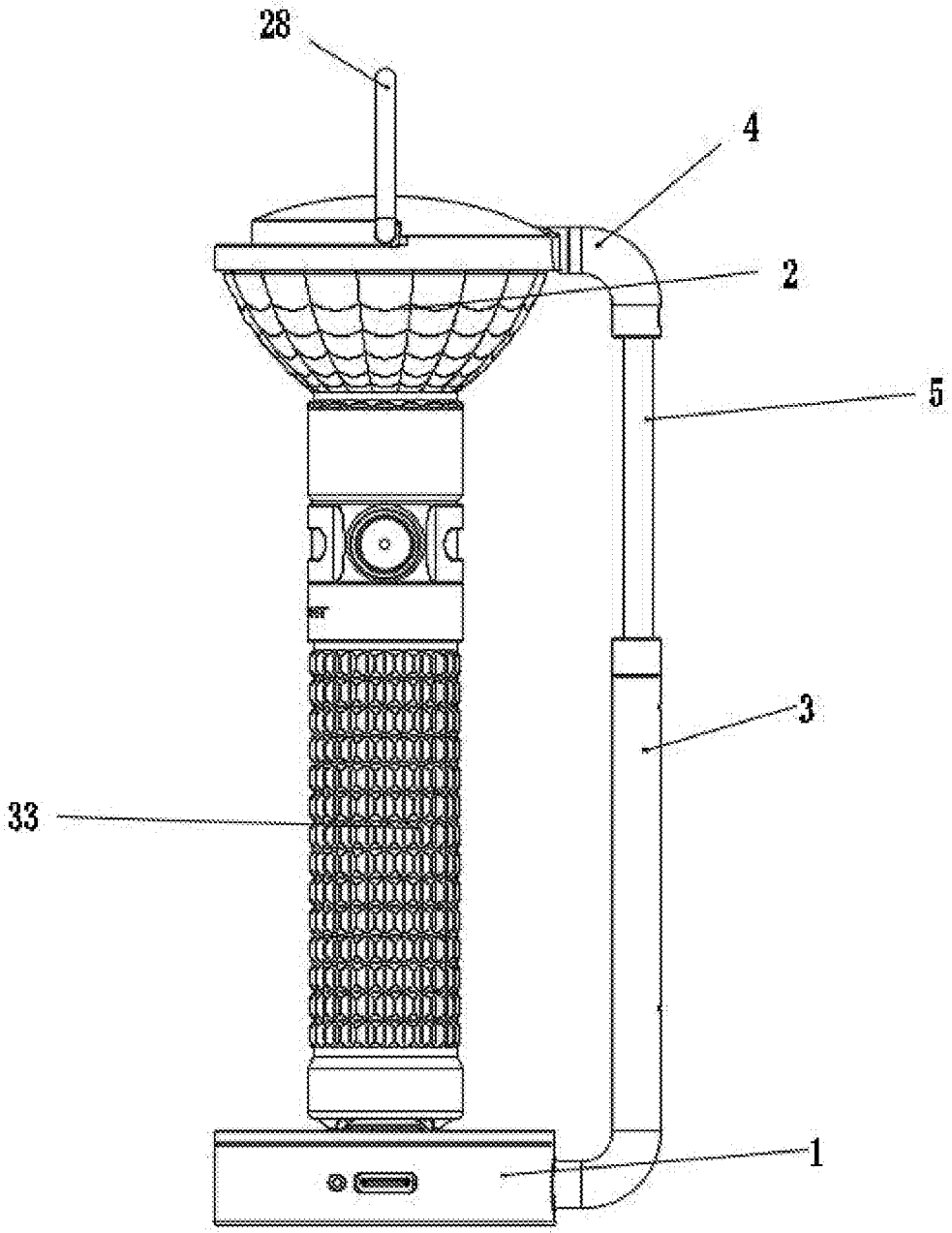
FIG. 4 is the structural diagram of the multifunctional flashlight support with the flashlight installed.

As shown in FIG. 1-FIG. 4, in the embodiment, the connecting rod assembly comprises a first bending rod 3 and a second bending rod 4, and the first bending rod 3 further comprises a bending portion 301 and a telescopic portion 302, wherein, a telescopic rod 5 is contained in the inner cavity of the telescopic portion 302, and the telescopic rod 5 is connected in a slidable way with the first bending rod 3. The telescopic rod 5 is of a cylindrical structure with a side section, an anti-rotating block 11 is arranged on the end of the telescopic portion 302 close to the second bending rod 4, and the anti-rotating block 11 is fit with the side section of the telescopic rod 5 to serve for preventing the telescopic rod 5 from rotating relative to the first bending rod 3. In addition, external threads are made on the end of the telescopic portion 302 close to the second bending rod 4, and the external threads of the telescopic rod 5 are matched with a steel sleeve 6 with internal threads; the minimum inside diameter of the steel sleeve 6 is smaller than the maximum outside diameter of the telescopic rod 5, and the steel sleeve 6 is used for preventing the telescopic rod 5 from releasing from the telescopic portion 302. As shown in FIG. 4, the telescopic rod 5 can be slide relative to the first bending rod 3, so as to increase the overall height of the connecting rod assembly and adapt to flashlights of different heights, showing a high applicability.

In this embodiment, a first locating ball 7 is further arranged at the telescopic rod 5, at least one first locating hole corresponding to the position of the first locating ball 7 is arranged in the inner wall of the first bending rod 3, and the first locating hole and the first locating ball 7 are matched for providing the in-place indication of the telescopic rod 5 extending or retracting. When the telescopic rod 5 extends or retracts, the first locating ball 7 is clamped into the first locating hole for providing the in-place indication as the first locating ball 7 slides to a certain position. In some embodiments, two first locating holes or more first locating holes at an equal space or unequal space may be arranged in the inner wall of the second bending rod 4 according to the required spacing distance for extension and retraction, so as to provide the in-place indication of extension or retraction in different positions, even through the ambient light is insufficient.

At least one lantern ring 8 is further arranged on the outside wall of the telescopic rod 5, and the lantern ring 8 is fit with the inner wall of the first bending rod 3, thereby playing a damping role in extension and retraction of the telescopic rod 5. In this embodiment, the number of lantern rings 8 is 2. In some embodiments, the first washer 15 is made of rubber materials or plastic materials. Preferably, the lantern rings 8 are made of rubber materials.

Figure 6:
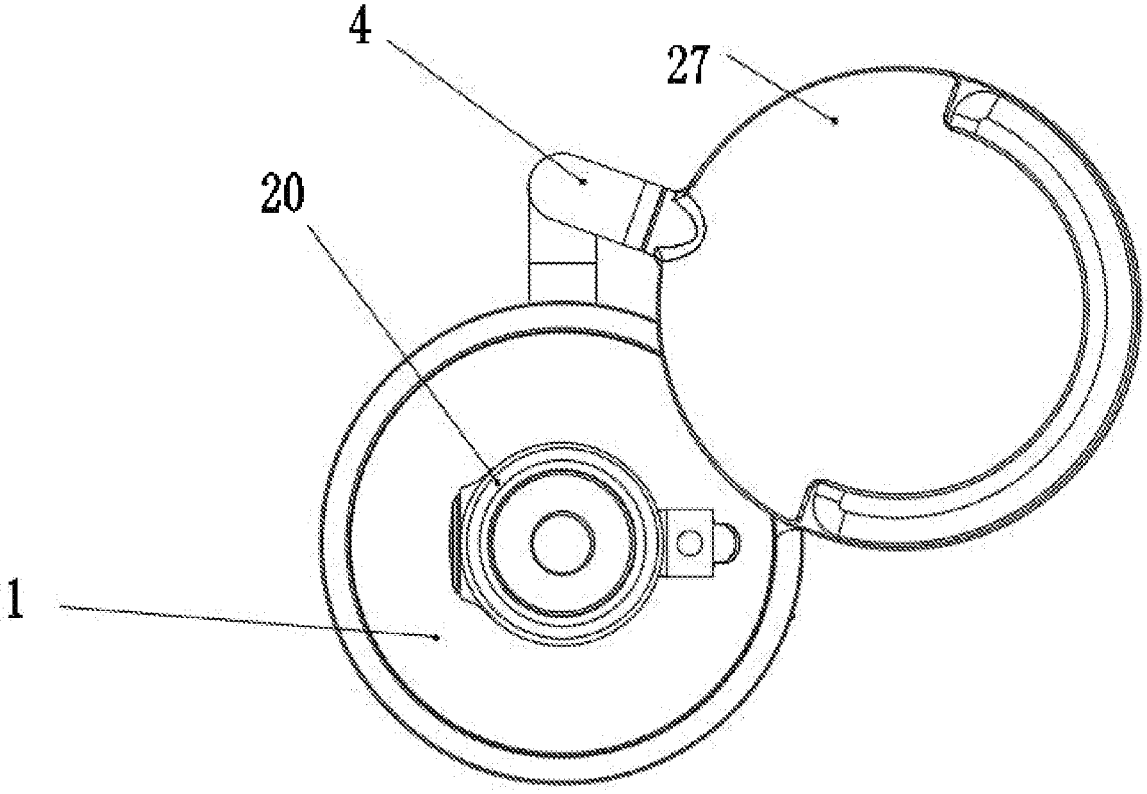
FIG. 6 is the top view of the multifunctional flashlight support with the optical component rolled out.
Figure 7:
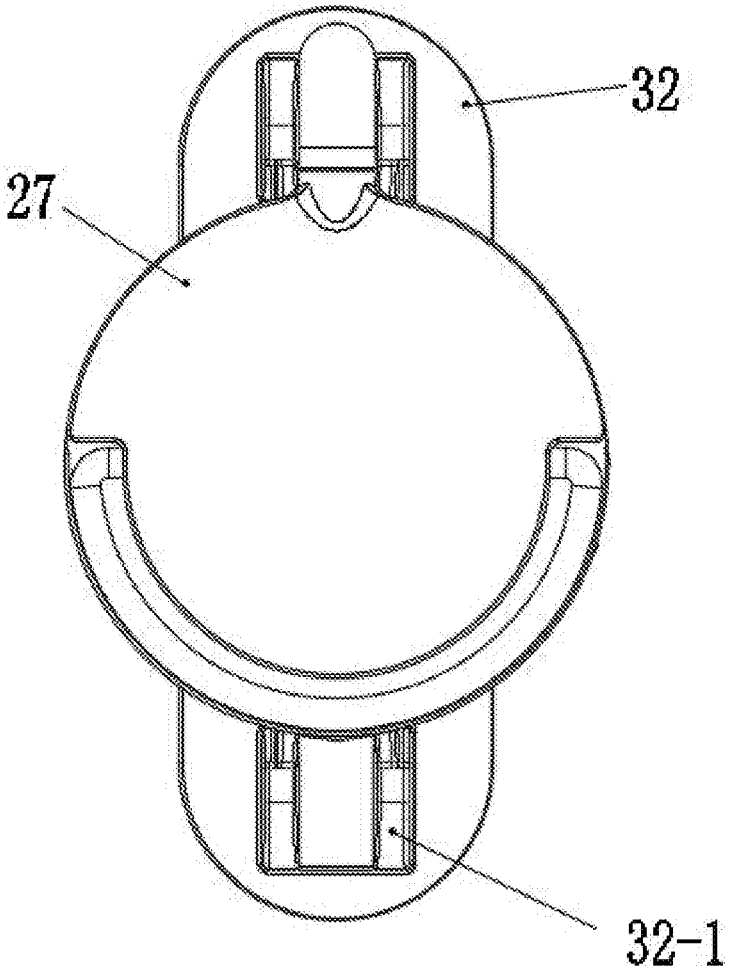
FIG. 7 is the top view of the multifunctional flashlight support with the optical component aligned to the base.
Figure 8:
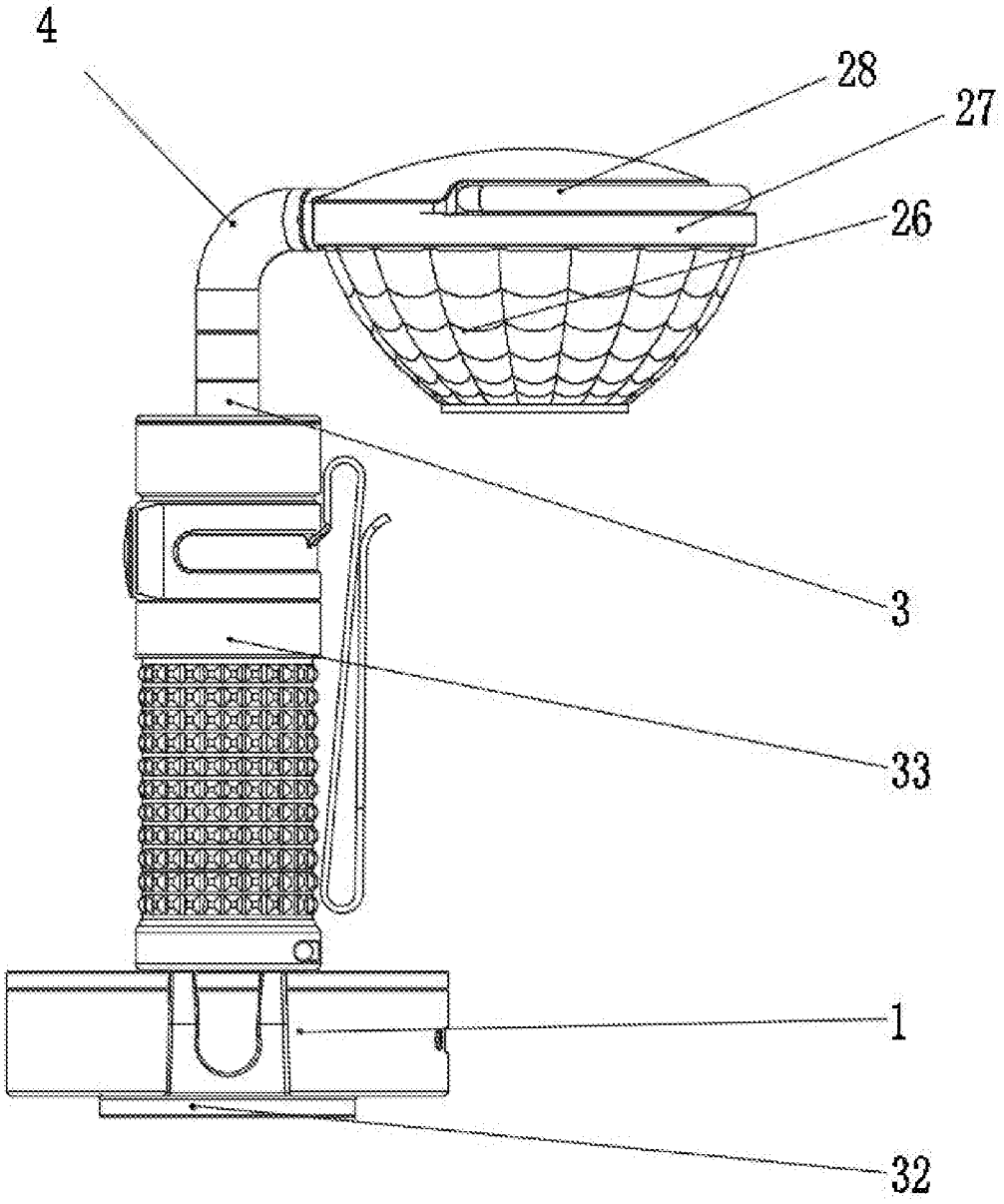
FIG. 8 is the main view of the multifunctional flashlight support with the optical component rolled out.

The telescopic rod 5 is connected in a rotatable way with the second bending rod 4. In this embodiment, the telescopic rod 5 is connected with the second bending rod 4 through a pin 9. A first limiting hole is arranged in the second bending rod 4, and the first limiting hole plays a role in connection and rotation limitation. The pin 9 can slide in the first limiting hole, so the second bending rod 4 can be rotated relative to the first bending rod 3. As shown in FIG. 6 and FIG. 8, the optical component 2 is rotated away by rotating the second bending rod 4 before the flashlight is installed; after the base 1 and the flashlight are installed, the optical component 2 is turned back. The whole installation process is simple and convenient, with no need of hard work, suitable for different people.

As shown FIG. 2, in this embodiment, a second locating ball 10 is arranged for the telescopic rod 5, a second locating hole corresponding to the position of the second locating ball 10 is arranged in the inner side of the second locating ball 4, and the second locating ball 10 and the second locating hole are matched for providing the in-place indication when the second bending rod 4 rotates around the telescopic rod 5.

A first screw 12 is arranged for the bending portion 301, the first screw 12 is fixed on the first bending rod 3, and the head of the first screw 12 is clamped into the inner hole wall of the base 1, so the first bending rod 3 is prevented from releasing from the base 1. A wavy groove 301-1 is arranged for the bending portion 301, a locating block 13 is arranged in the inner groove of the base 1, and a wavy convex tooth structure matched with the wavy groove 301-1 is arranged on the locating block 13; the locating block 13 is engaged with the first bending rod 3, and the first bending rod 3 can be rotated by a certain angle according to the pitch of convex teeth. A first elastic piece 14 is connected with the locating block 13, with one end abutting against the locating block 13 and the other end abutting against the inner groove wall of the base 1. When the first bending rod 3 is rotated, the first bending rod 3 is staggered with the convex teeth on the locating block 13, the locating block 13 is pushed towards the base 1, and the first elastic piece 14 is compressed; under the recovery trend action of the first elastic piece 14, the first bending rod 3 can be engaged with the locating block 13 again quickly, achieving the quick rotational locating. A first washer 15 is arranged at the connection point between the first bending rod 3 and the base 1, located outside the first bending rod 3 and abutting against the inner groove wall of the base 1; the first washer 15 plays a damping role when the first bending rod 3 rotates.

The base 1 comprises a bottom shell 101 and an upper cover 102, wherein, the bottom shell 101 and the upper cover 102 form a cavity, a charging device is contained in the cavity, a power interface 16 is connected with the charging device, and the charging device is connected with an external power supply through the power interface 16. In this embodiment, the power interface 16 is a TYPE-C interface, used for connecting an external adapter during charging, so the flashlight is charged from the mains supply.

A charging PCB 17, a charging connecting plate 18 and a contact cap 19 are arranged in the charging device from bottom to top in sequence. The power interface 16 is arranged on the charging PCB 17, the charging PCB 17 is connected with the charging connecting plate 18 through second elastic pieces 17-1, and the second elastic pieces 17-1 are connected with a copper sheet on the back of the connecting plate 18. In this embodiment, the second elastic pieces 17-1 are made of metal materials, and the number of the second elastic pieces 17-1 is 2.

As shown in FIG. 1-FIG. 3, a third elastic piece 18-1 is arranged at the top of the charging connecting plate 18. The third elastic piece 18-1 is connected with the contact cap 19, and the contact cap 19 is exposed on the base 1 after penetrating the top plate of the upper cover 102. A metal ring 20 is arranged at the top plate of upper cover 102, the contact cap 19 is surrounded by the metal ring 20, and the contact cap 19 and the metal ring 20 are welded and come into contact with the flashlight on the base 1. In this embodiment, the contact cap 19 and the metal ring 20 are made of metal copper materials, playing a role in electrical conduction. In some embodiments, the upper cover 102 is made of insulating materials. In this embodiment, the upper cover 102 is made of rubber materials. In this embodiment, the charging PCB 17 is fixed to the upper cover 102 by a second screw 21, and the second screw 21 is a countersunk head self-tapping screw.

In this embodiment, a magnet 22 is connected between the charging connecting plate 18 and the back of the upper cover 102. The magnet 22, with a ring structure, is arranged in the position corresponding to the metal ring 20 to form a magnetic attraction connection. The tail of the flashlight is in magnetic attraction connection with the charging device under the action of the magnet 22 to form a loop, so that the flashlight can be charged through the base 1. The base 1 in this embodiment can be used for placing the flashlight, and serve as the charging device. The magnetic attraction connection achieves simpler connection between the charging device and the flashlight, and easier carrying.

The upper cover 102 and the bottom shell 101 are press-fitted together through a hold-down ring 23, and an indicator light plug 24 is arranged in a through hole in the side wall of the bottom shell 101; light from an indicator light in the base 1 can be transmitted through the indicator light plug 24. The indicator light, connected in an electrical way with the charging PCB 17, can emit the light in different colors according to the charging state of the flashlight. In this embodiment, the indicator light can emit red or green light. When the flashlight is being charged by the charging device, the indicator light emits red light; when the charging device detects that the flashlight is charged fully, the indicator light emits green light. In this embodiment, the indicator light plug 24 is made of semitransparent silica gel materials. In other embodiments, the indicator light plug 24 can be further made of other semitransparent or fully transparent materials. In this embodiment, the bottom shell 101 is made of aluminum alloy materials, and the hold-down ring is made of stainless steel materials.

A third locating ball 25 is arranged for the second bending rod 4, located at the end close to the optical component 2. A third locating hole corresponding to the third locating ball 25 is arranged for the optical component 2. The third locating ball 25 and the third locating hole are matched for providing the in-place indication when the optical component 2 rotates around the second bending rod 4.

The optical component 2 comprises a lens assembly and a light filtering assembly, wherein, the light filtering assembly is arranged at the light inlet of the lens assembly. The lens assembly comprises a lens 26 and a top cover 27, wherein, the top cover 27 is located on the side of the lens 26 far away from the light inlet, the second bending rod 4 is connected in a rotatable way with the top cover 27 through the second locating ball 10, and the second locating ball 10 can slide in the inner groove of the top cover 27, so the optical component 2 can be rotated relative to the second bending rod 4 within a certain angle range. At least one second locating hole corresponding to the second locating ball 10 is arranged in the top cover 27; the second locating ball 10 and the second locating hole are matched for providing the rotational locating function, and providing the in-place indication for rotation of the optical component 2. The support shape can be designed freely through rotation of the optical component 2 to provide convenience for stowage of the support.

The lens 26 comprises a refracted optical surface and/or a reflective optical surface. When the light inlet of the optical component 2 abuts against the flashlight on the base 1, light of the flashlight enters the inner cavity of the lens through the light inlet of the lens 26, and the light rays diverge to the periphery of the lens 26 after being refracted and/or reflected. The direction of the light rays of the flashlight is changed through the refracted optical surface and/or reflective optical surface of the lens 26, so the flashlight can be used as a desk light or a camping light when the flashlight is installed on the support, with the lighting function achieved when it is not held by hand. In some embodiments, the refracted optical surface and/or reflective optical surface can be designed according to the actually required lighting direction, and the light rays of the flashlight can be changed and emitted according to the preset direction, meeting the lighting functions of the desk light, the camping light or additional lighting equipment.

A hanging ring 28 is arranged on the top cover 27. The hanging ring 28 is connected in a rotatable way with the top cover 27. The hanging ring 28 is opened by rotation, and the support with the flashlight can be hung on a branch or a nail as the camping light. In this embodiment, the top cover 27 is made of the aluminum alloy materials, and the support is light in overall weight, easy to carry.

The light filtering assembly comprises an optical filter 29 and a light filter frame 30 for installing the light filter. The light filtering assembly is installed at the light inlet of the lens 26, and connected with a second washer 31; the second washer 31 is arranged between the light filtering assembly and the lens assembly, playing a elastic and damping role. In this embodiment, the second washer 31 is made of soft silica gel. In some embodiments, the optical filter can be made of colored semitransparent plastic materials. Light in different colors can be emitted by using the optical filters in different colors, and the light color of the flashlight is changed. The flashlight is attracted on the base 1 through the magnetic attraction effect, and the head of the flashlight abuts against the optical component 2. The flashlight is turned on to emit soft light with uniform illuminance around the support under the joint light distribution effect of the optical filter and the lens 26. The flashlight can be used as the desk light for reading or the camping light.

In some embodiments, the optical component 2 can be specifically designed according to the lighting requirements. Through structural design of the optical component 2, the light of the flashlight is refracted and/or reflected in the preset direction, so the lighting range is expanded or concentrated, which will further expand the application of the flashlight.

In this embodiment, the support further comprises at least one first accessory 32, wherein, the first accessory 32 further comprises a platy shell and a mounting groove 32-1 protruding from the platy shell, and the first accessory 32 is connected in a detachable way with the connecting rod assembly through the mounting groove. As shown in FIG. 2, the first accessory 32 is installed at the bottom of the base 1 through connection with the bending portion 301 of the first bending rod 3, increasing the contact surface for placing the support. When used as the desk light, the flashlight can be placed on the desk top stably. As shown in FIG. 1, the first accessory 32 can be further installed on the side of the connecting rod assembly, and the support with the flashlight can be pasted on the wall, used as a wall light, through adding binders or an adhesive tape to the side of the platy shell far away from the mounting groove 32-1. In some embodiments, two or more first accessories 32 can be arranged for different occasions.

In this embodiment, the first elastic piece 14, the second elastic piece 17-1 and the third elastic piece 18-1 are all springs. In other embodiments, the first elastic piece 14, the second elastic piece 17-1 and the third elastic piece 18-1 can also be elastic sheets or flexible blocks.

In this embodiment, the first locating ball 7, the second locating ball 10 and the third locating ball 25 are composed of a shell, a steel ball and a spring.

In this embodiment, the multifunctional flashlight support further comprises the second accessory which is an adapter. When the flashlight on the base 1 is charged, the power interface 16 is connected with the adapter, so the flashlight is charged from the external power supply.

The above-mentioned embodiments are only the preferable embodiments of the invention, and all common changes and replacements made by those skilled in the art within the range of the technical solution of the invention should fall within the protection range of the invention.

What is claimed is:

1. A multifunctional flashlight support, characterized in that it comprises a base (1), a connecting rod assembly and an optical component (2), wherein, the base (1) is connected with the optical component (2) through the connecting rod assembly, a flashlight is installed in a detachable way on the base (1), and the optical component (2) abuts against the light outlet of the flashlight to serve for changing the light direction of the flashlight; the connecting rod assembly is connected in a rotatable way with the optical component (2) and the base (1) separately.

2. The multifunctional flashlight support according to claim 1, characterized in that the connecting rod assembly comprises a first bending rod (3) and a second bending rod (4), wherein, the first bending rod (3) is connected in a rotatable way with the second bending rod (4), the base (1) is connected at the end of the first bending rod (3) far away from the second bending rod (4), and the optical component (2) is connected at the end of the second bending rod (4) far away from the first bending rod (3).

3. The multifunctional flashlight support according to claim 2, characterized in that the first bending rod (3) comprises a bending portion (301) and a telescopic portion (302), wherein, the bending portion (301) is connected in a rotatable way with the base (1), a telescopic rod (5) is contained in the inner cavity of the telescopic portion (302), the telescopic rod (5) is connected in a slidable way with the first bending rod (3), and the telescopic rod (5) is connected in a rotatable way with the second bending rod (4).

4. The multifunctional flashlight support according to claim 1, characterized in that a charging device and a power interface (16) are arranged in the base (1), the charging device is connected with an external power supply through the power interface (16), and the charging device is used for charging the flashlight installed on the base.

5. The multifunctional flashlight support according to claim 4, characterized in that a magnetic interface for connecting the flashlight is arranged on the charging device.

6. The multifunctional flashlight support according to claim 1, characterized in that the optical component (2) comprises a lens assembly, and the lens assembly further comprises a lens (26) and a top cover (27), wherein, the top cover (27) is located on the side of the lens (26) far away from a light inlet, and light from the flashlight enters an inner cavity of the lens (26) through the light inlet and diverges around the lens (26) after being refracted and/or reflected.

7. The multifunctional flashlight support according to claim 6, characterized in that the optical component further comprises a light filtering assembly, wherein, the light filtering assembly is arranged at the light inlet of the lens.

8. The multifunctional flashlight support according to claim 6, characterized in that a hanging ring (28) is arranged on the top cover (27), and the hanging ring (28) is connected in a rotatable way with the top cover (27).

9. The multifunctional flashlight support according to claim 1, characterized in that it comprises at least one first accessory (32), and the first accessory (32) further comprises a platy shell and a mounting groove (32-1) protruding from the platy shell, wherein, the first accessory (32) is connected in a detachable way with the connecting rod assembly through the mounting groove (32-1).

* * * * *